United States Patent [19]

Izzi et al.

[11] Patent Number: 4,582,097

[45] Date of Patent: Apr. 15, 1986

[54] CONTROL APPARATUS AND METHOD FOR AUTOMATIC FILLING MACHINE

[75] Inventors: Anthony J. Izzi, Malvern; John J. McDonald, West Chester; William B. Parker, Devon; Robert K. Famous, Norristown; Yoshio Nakajima, Plymouth Meeting, all of Pa.

[73] Assignee: Mateer-Burt Company, Inc., Wayne, Pa.

[21] Appl. No.: 539,194

[22] Filed: Oct. 5, 1983

[51] Int. Cl.[4] ..... B65B 1/12

[52] U.S. Cl. ..... 141/1; 222/1; 222/643

[58] Field of Search ..... 73/3; 141/1, 196; 198/504; 222/14, 643; 221/1

[56] References Cited

U.S. PATENT DOCUMENTS

| | | | |
|---|---|---|---|
| Re. 23,888 | 10/1954 | Mateer | 222/70 |
| Re. 24,079 | 10/1955 | Mateer | 222/378 |
| 3,743,140 | 7/1973 | Sauerbrey | 222/63 |
| 4,331,262 | 5/1982 | Snyder et al. | 222/37 |
| 4,442,953 | 4/1984 | Miyamoto et al. | 222/14 |

*Primary Examiner*—Stephen Marcus
*Assistant Examiner*—Mark Thronson
*Attorney, Agent, or Firm*—Seidel, Gonda, Goldhammer & Abbott

[57] ABSTRACT

A control apparatus for a filling machine of the type employing a hopper and rotary feed auger determines the exact number of auger revolutions required to deliver a preselected weight of material to be dispensed by weighing the volume of material delivered by a given number of auger revolutions and computing the ratio of the number of auger revolutions to the weight of the volume delivered. The ratio is then divided into the desired weight to determine the actual number of auger revolutions required to deliver the desired weight. The control apparatus also measures the amount of rotation of the rotary auger after the auger is braked at the end of each fill cycle and increments or decrements a preselected set point number of auger revolutions, depending upon whether the actual number of auger revolutions is greater than or less than the set point, to compensate for auger rotation after braking.

54 Claims, 6 Drawing Figures

CONTROL APPARATUS AND METHOD FOR AUTOMATIC FILLING MACHINE

BACKGROUND OF THE INVENTION

The basic concept of filling containers by dispensing materials from a hopper using a rotary feed mechanism is well known. See, for example, U.S. Pat. Nos. Re. 23,888 and Re. 24,079. Apparatus such as that shown in these patents can be used for volumetric filling of free-flowing and non-free-flowing granular, powdered, flaked or paste material. Typically, the feed mechanism is positioned in an opening in the bottom of a vertically-disposed conical hopper and consists of either an auger or a pump. The auger, pump rotor, or other rotational member is driven by a prime mover, such as an electric motor, through a clutch-brake mechanism which connects the driving shaft of the motor to the driven shaft of the rotational member. The clutch-brake mechanism is controlled to rotate the driven shaft for a pre-selected number of revolutions by a device which counts the number of revolutions. This is a relatively accurate way of volumetrically dispensing material since the amount of material dispensed by each revolution of the auger or pump can be accurately determined. For example, for each revolution of an auger of known pitch and diameter, the volume of material dispensed from its discharge end can be determined. By appropriate control, the auger can be made to run through sequential cycles of a predetermined number of turns. During each cycle, therefore, a predetermined volume of material is discharged into a container positioned by mechanized packaging devices between the discharge end of the feed mechanism. Mechanized packaging line devices for sequentially positioning containers made of paper, metal, plastic or glass are well known.

Since each revolution of the feed mechanism dispenses a known amount of material, it follows that the number of revolutions is a measure of the volume of material that has been dispensed. There are two methods for determining the number of revolutions. The first method is to directly count the number of revolutions. The second method is to measure the time period over which the feed mechanism is being driven at a constant speed. In known apparatus, devices for counting the number of revolutions include counters directly linked by gearing the output side of the clutch-brake mechanism mentioned above, and shaft encoders directly or indirectly coupled to the driven shaft which generate a given number of pulses for each complete revolution of the driven shaft. When the correct count is reached, the driven shaft is disengaged from the driving shaft and braked by the clutch-brake mechanism. Although such mechanisms are manufactured with precision and assembled with rigorous quality monitoring, in some cases inherent errors result in a repetitive accuracy of performance less than desired.

The timed method of controlling the number of revolutions is less accurate than the count method, although in certain cases the timed method of controlling the number of revolutions may yield acceptable accuracy.

One factor which contributes to the inherent inaccuracies in the direct counting method of determining the number of shaft revolutions is what may be termed shaft "coast". It is known that, due to the inertia of a rotating shaft and practical limits on the braking system, a rotating shaft will continue to rotate for a fraction of a revolution or even several revolutions after the brake is applied before coming to a complete stop. This additional, unwanted rotation of the shaft after the brake is applied and before it comes to a complete stop is referred to as "coast". Obviously, as an auger shaft coasts beyond the desired number of turns it continues to dispense material from the hopper. This results in over-filling of the containers, with concomitant spilling, waste and loss of time and money to the packer.

It is an object of the present invention to compensate for the coast inherent in any filling machine so that a more accurate fill is obtained.

In addition to compensating for coast, there is another aspect to the invention. As noted above, known filling machines operate in a volumetric mode. That is, for an auger of known pitch and diameter, each revolution of the auger dispenses a given volume. However, in many instances, the material being filled into the container is ultimately sold to the consumer by weight, not volume. Thus, in order to fill a one-pound coffee can with one pound of coffee, for example, the filling machine must dispense a particular volume of coffee which will have a weight of one pound. Obviously, the weight of the material dispensed is equal to the product of the density of the material times the volume dispensed. Variations in density, due to factors such as temperature, humidity or other factors, will result in different weights of material for a given volume. In order for an operator to be sure that he is consistently filling containers to the proper weight, he must engage in a lengthy, time-consuming and potentially inaccurate process of finding the volume which gives him the desired weight for a particular product run. Typically, this necessitates a large number of trial cycles in which the operator fills a container with a volume which he estimates will give him the desired weight. He then weighs the container, and adjusts the volume delivered depending upon whether the weight is high or low. Depending upon the operator's skill and the particular product and ambient conditions, this may take a large number of trials.

It is another object of the invention to eliminate the need for a large number of trial fill cycles when setting up a filler machine and to permit the number of auger revolutions required to dispense a given weight in a single trial fill operation.

SUMMARY OF THE INVENTION

The present invention is directed to a filler apparatus which comprises a hopper means for storing material to be dispensed by the filler and rotary feed means operatively associated with the hopper means for dispensing controlled volumes of material from a discharge opening in hopper means into containers to be filled. The volumes of material dispensed are directly proportional to the number of revolutions of the rotary feed means. The invention includes means for sensing the number of revolutions of the rotary feed means and generating a signal indicative of the number of revolutions. Control means are provided for selectively controlling the number of revolutions of the rotary feed means to either a preselected fixed number or to a calculated number, the control means having as an input the signal indicative of the number of revolutions, the control means further having means for entering a first weight value indicative of the weight of a volume of material delivered by the preselected fixed number of revolutions of the rotary feed means, means for entering a second value indicative of a desired weight of material to be dispensed by the filler, means for deriving the ratio of the first weight value to the preselected fixed number of revolutions of the rotary feed means, and means for dividing the second weight value by said ratio to derive the calculated number. The calculated number is indicative of the number of revolutions required to dispense the second weight value. Cyclically engagable drive means are operatively associated with the rotary feed means and responsive to the control means for rotating the rotary feed means by either the preselected fixed number or the calculated number as selected by the control means.

The present invention also includes a filler apparatus comprising a hopper means for storing material to be dispensed by the filler and rotary feed means operatively associated with the hopper means for dispensing controlled volumes of material from a discharge opening in the hopper means into containers to be filled. The volumes of material discharged are directly proportional to the number of revolutions to the rotary feed means. The filler apparatus has cyclically engagable drive means for rotating the rotary feed means and brake means for stopping the rotation of the rotary feed means after a predetermined number of revolutions. The apparatus includes means for sensing the actual number of revolutions of the rotary feed means from the time the drive means is engaged until the rotary feed means comes to a complete stop and generating a signal indicative of the actual number of revolutions, and coparison means for comparing the actual number of revolutions of the rotary feed means to said predetermined number of revolutions. Control means responsive to said comparison means increments said predetermined number by a preselected amount when the actual number of revolutions is less than said predetermined number and decrements said predetermined number by said preselected amount when the actual number of revolutions is greater than said predetermined number.

The present invention in addition includes a method of determining the number of revolutions required of a rotary feed means in a filling machine of the type employing a rotary feed means in a hopper to deliver a desired weight of material into containers being filled, comprising the steps of rotating the rotary feed means through a preselected fixed number of revolutions to thereby dispense a volume of material directly proportional to the preselected fixed number of revolutions; collecting the dispensed volume of material in a container; weighing the container and material and determining the weight of the dispensed volume of material; determining the ratio of the preselected fixed number of revolutions to said weight; determining the product of said ratio multiplied by the desired weight of material; and rotating the rotary feed means through the number of revolutions equal to said product to dispense said desired weight.

The present invention further includes a method of compensating for continued rotation after braking of a rotating shaft which is caused to rotate and then braked after rotating through a predetermined number of revolutions in order to have the shaft come to a complete stop after the desired number of revolutions, comprising the steps of measuring the actual number of revolutions of the shaft from the time it is first caused to rotate until it comes to a complete stop after braking; comparing the actual number of revolutions to the predetermined number of revolutions; and incrementing said predetermined number of revolutions by a preselected amount when the actual number of revolutions is less than said predetermined number and decrementing said predetermined number by said preselected amount when the actual number of revolutions is greater than said predetermined number.

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

DETAILED DESCRIPTION OF THE INVENTION

Figure 1:
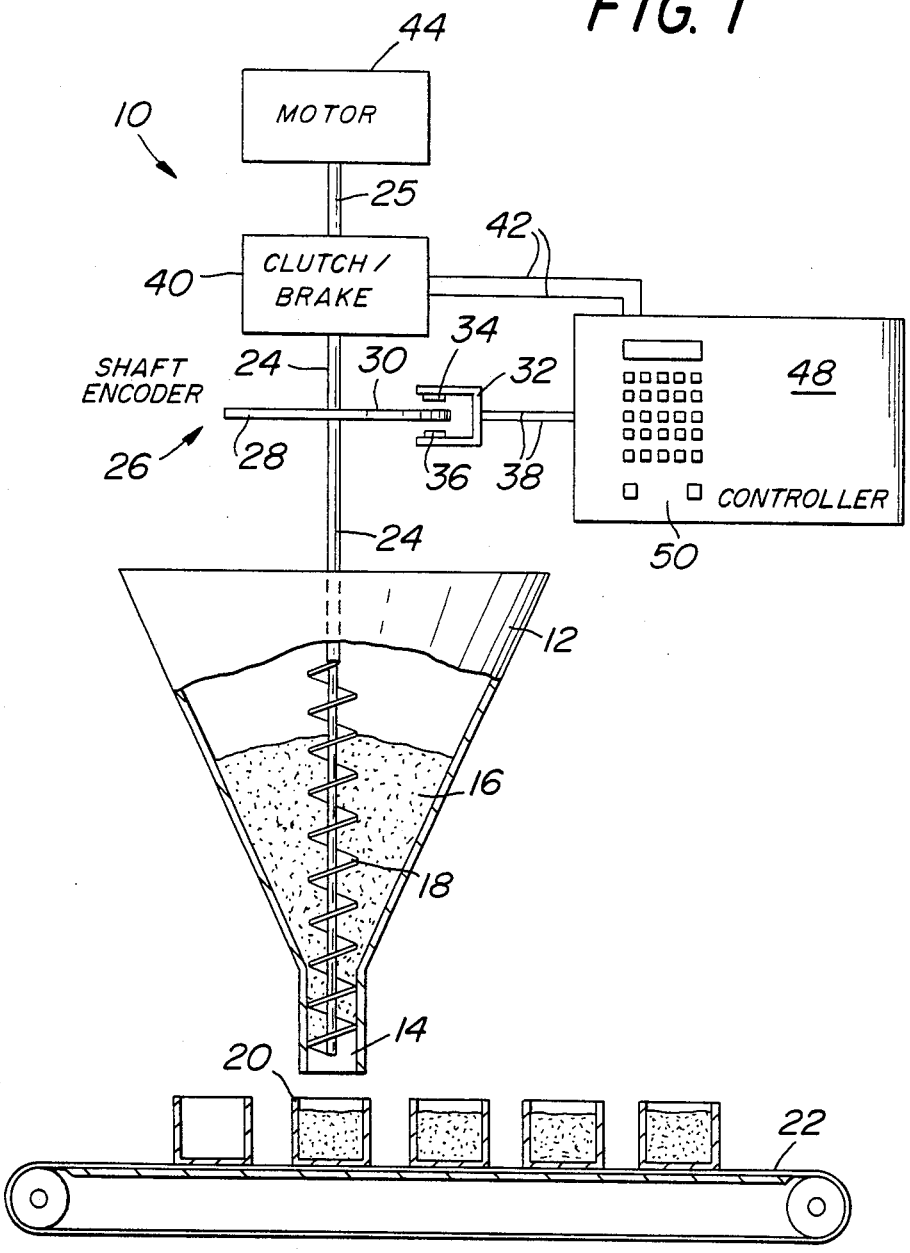
FIG. 1 illustrates a filling apparatus in accordance with the present invention in schematic form.
Figure 1A:
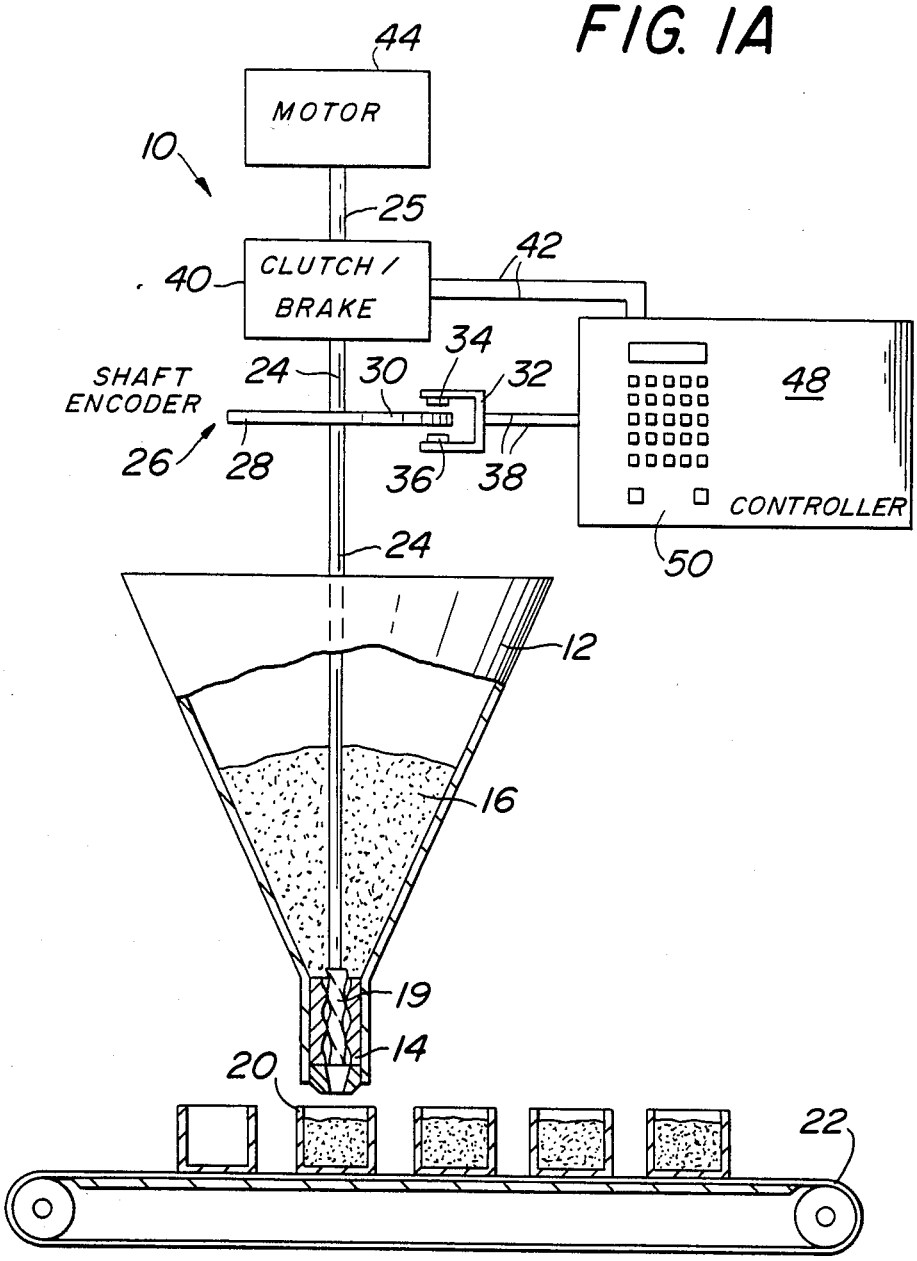
FIG. 1A illustrates the filling apparatus of FIG. 1 which employs a different rotary feed means.

Referring now to the drawings, wherein like numerals indicate like elements, there is shown in FIG. 1 in schematic form a filling apparatus 10 in accordance with the present invention. Apparatus 10 has a hopper 12 for storing material to be dispensed. Hopper 12 has generally the shape of an inverted cone. The bottom end of hopper 12 terminates in generally cylindrical outlet 14.

A feed auger 18 is fitted within the outlet 14 at the bottom end of hopper 12. Rotation of the auger 18 causes material 16 to be dispensed from hopper 12 through outlet 14 into containers 20 which are positioned manually or by a conveyor 22 beneath hopper 12. Conveyor 22 may be any well-known and widely employed conveyor for indexing individual containers to be filled beneath hopper outlet 14.

It should be understood that by illustrating an auger there is no intention to limit the invention to filling machines which utilize an auger. Auger 18 could just as well be a screw rotor 19 of a Moyno type pump such as that shown in U.S. Pat. No. Re. 24,079. However, for purposes of illustrating the invention, reference will be made to an auger.

Auger 18 may be caused to rotate by means of auger shaft 24. The lower end of shaft 24 may be integral with or otherwise securely fastened to auger 18. The upper end of shaft 24 is connected through clutch-brake 40 to driving motor 44. For purposes of illustrating the invention, clutch-brake 40 and motor 44 are coupled by shaft 25. Clutch-brake 40 and motor 44 may be any conventional motor and clutch brake. Such devices are well-known and widely used in the art and need not be explained here in detail.

A shaft encoder assembly 26 is coupled to auger shaft 24. Shaft encoder assembly 26 may be an electrooptic shaft encoder such as that shown in U.S. Pat. No. 3,743,140. Alternatively, shaft encoder 26 may be any type of shaft encoder which generates signals indicative of the rotation of auger shaft 24. In the particular embodiment illustrated in FIG. 1, shaft encoder 26 consists of a disk 28 which is coupled to shaft 24 so as to rotate with it. The function of disk 28 is to act as a light chopper. For this purpose, it is provided with a plurality of slots, lines or holes 30 which are evenly spaced about its periphery. The number of slots, lines or holes 30 can be varied. However, for convenience the preferred embodiment may have 100 slots, thereby providing a number which is easily divisible to indicate a complete revolution of shaft 24 and hence auger 18. A bracket 32 supports a light source 34. Light source 34 may be the filament of an incandescent lamp or a light emitting diode which generates a constant light output. Bracket 32 also supports a photodetector 36, such as a phototransistor or the like, which is sensitive to the light energy generated by the light source 34.

The light source 34 and the photo detector 36 are positioned by the bracket 32 in opposing relation adjacent the peripheral edge of the disk 28. Thus, light energy emitted by the light source 34 must pass through the slots 30 and the disk 28 in order to be detected by the photodetector 36. As a result, the output of the photodetector 36 will be a series of discrete electrical pulses whose frequency will depend upon the speed at which the shaft 24 is rotating. Likewise, the number of pulses generated in a given interval will indicate the extent to which shaft 24, and hence auger 18, has revolved in that interval.

The pulses generated by shaft encoder assembly 26 are fed to a controller 48 via wires 38. Similarly, clutch-brake 40 is connected to controller 48 by wires 42. Controller 48, which will be described in greater detail below, receives the pulses generated by shaft encoder assembly 26, processes them in a manner to be described and generates control signals which control the operation of clutch-brake 40. Controller 48 is provided with a control/display panel 50 which may display machine status and other information to an operator, and by means of which an operator may provide various inputs to controller 48.

Figure 2:
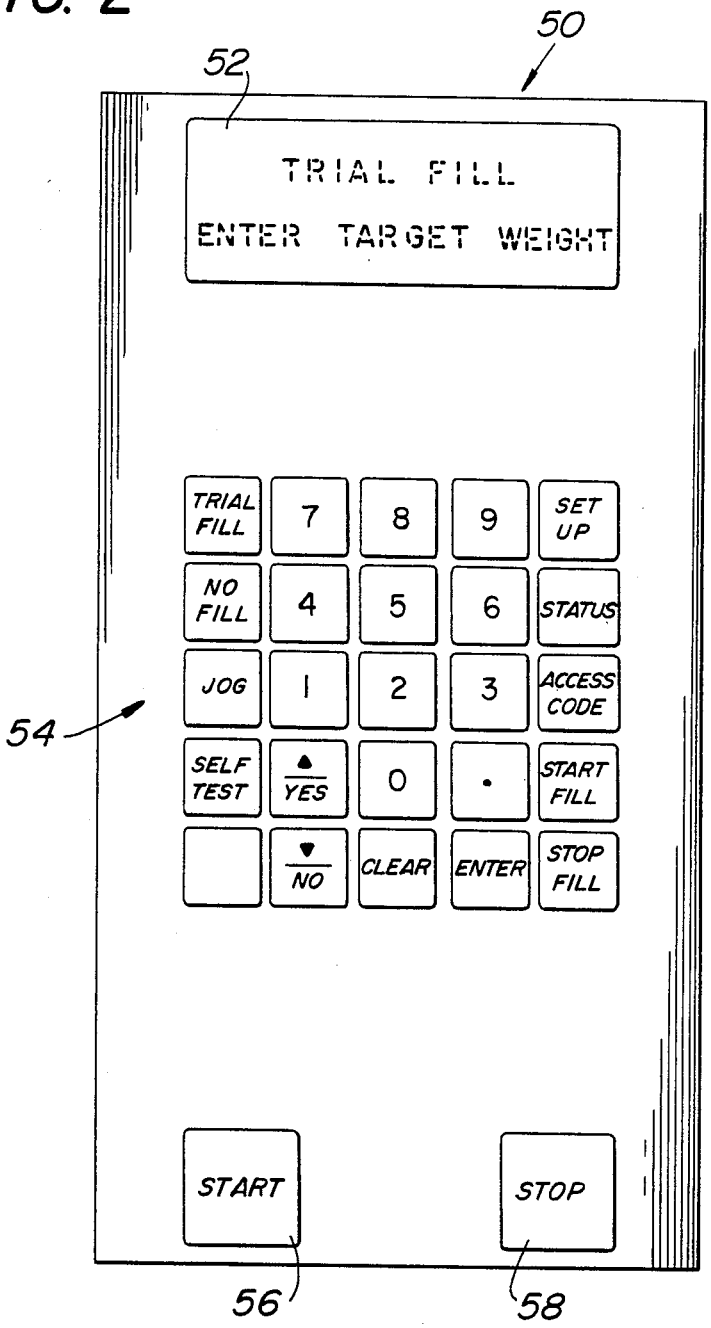
FIG. 2 illustrates a typical operator control panel of an apparatus in accordance with the present invention.

Control/display panel 50 is shown in greater detail in FIG. 2. Control/display panel 50 has a display section 52, which may be an LED display or liquid crystal display, or any other display suitable for displaying alphanumeric information to an operator. Display 52 may serve to display machine status, verify inputs entered by an operator, or display instructions to an operator to "prompt", or assist, the operator in providing necessary inputs or aid the operator in trouble shooting.

Adjacent display section 52 is an operator-actuated keyboard of push button assembly 54. This may be used by an operator to enter commands to the machine, enter data requested by the controller 48, and otherwise permit the operator to communicate with controller 48. Control panel 50 may also include start and stop buttons 56 and 58 for initiating and terminating machine operation.

Figure 3:
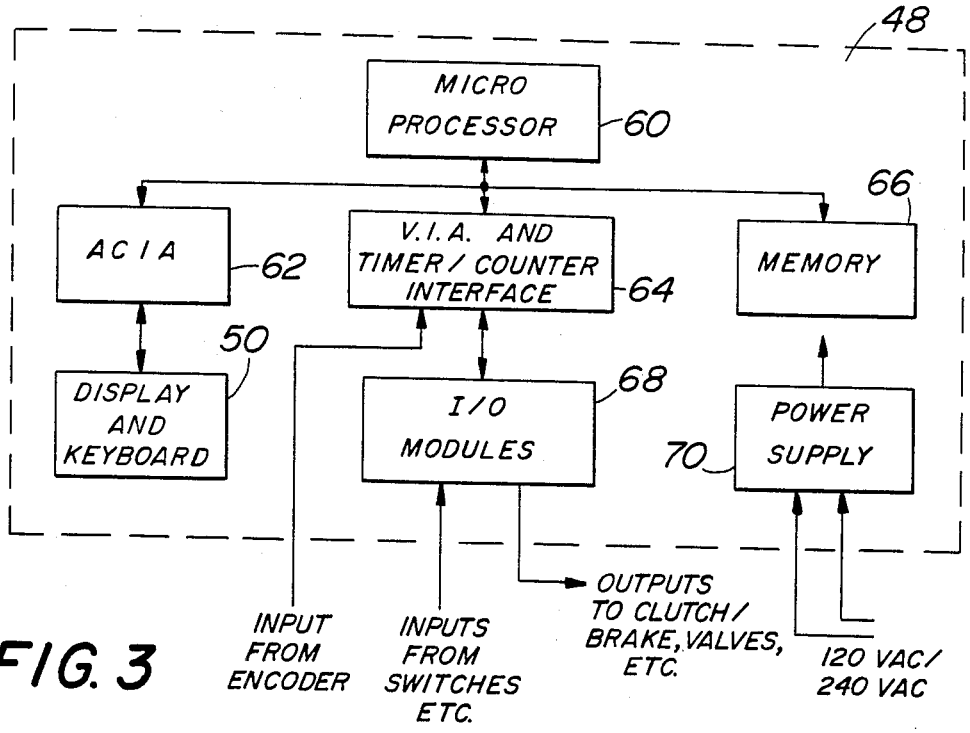
FIG. 3 is a block diagram of one embodiment of a control means in accordance with the present invention.

Controller 48 is illustrated in greater detail in block diagram form in FIG. 3. The heart of controller 48 is a microprocessor 60, which can be programmed to monitor and direct any number of machine functions. The operation of microprocessor 60 is synchronized with the remainder of the machine by input via versatile interface adapter (V.I.A.) and timer/counter interface 64. Operator inputs may be entered into microprocessor 60 via asynchronous control interface assembly (A.C.I.A.) 62, which translates operator-entered inputs from keyboard assembly 52 into a form usable by microprocessor 60. Likewise, A.C.I.A. 62 converts prompts and other messages generated by microprocessor 60 into operator-readable form for display by display section 52. The microprocessor 60 also receives inputs from other portions of the apparatus 10, such as the pulses generated by shaft encoder assembly 26, and generates control outputs to clutch-brake 40. Encoder pulses go directly into the V.I.A. 64. Other inputs and outputs are coupled to microprocessor 60 by means of I/O module 68. Controller 48 also includes a memory 66 which may be used to store data, commands and other information required by the microprocessor 60 or the operator to carry out various machine functions. Power supply 70 may be any conventional power supply and converts input power in the form of 120 V ac or 240 V ac into a dc voltage suitable for the controller electronics.

The general way in which controller 48 operates in the trial fill mode and the coast compensation mode in accordance with the present invention will now be described. It will be understood that the particular details of the programming of microprocessor 60 to carry out the steps of the present invention are not crucial to the present invention. Thus, microprocessor 60 and controller 48 may be arranged in any number of ways to carry out the steps of the present invention without departing from the scope and spirit of the invention.

TRIAL FILL

Figure 4:
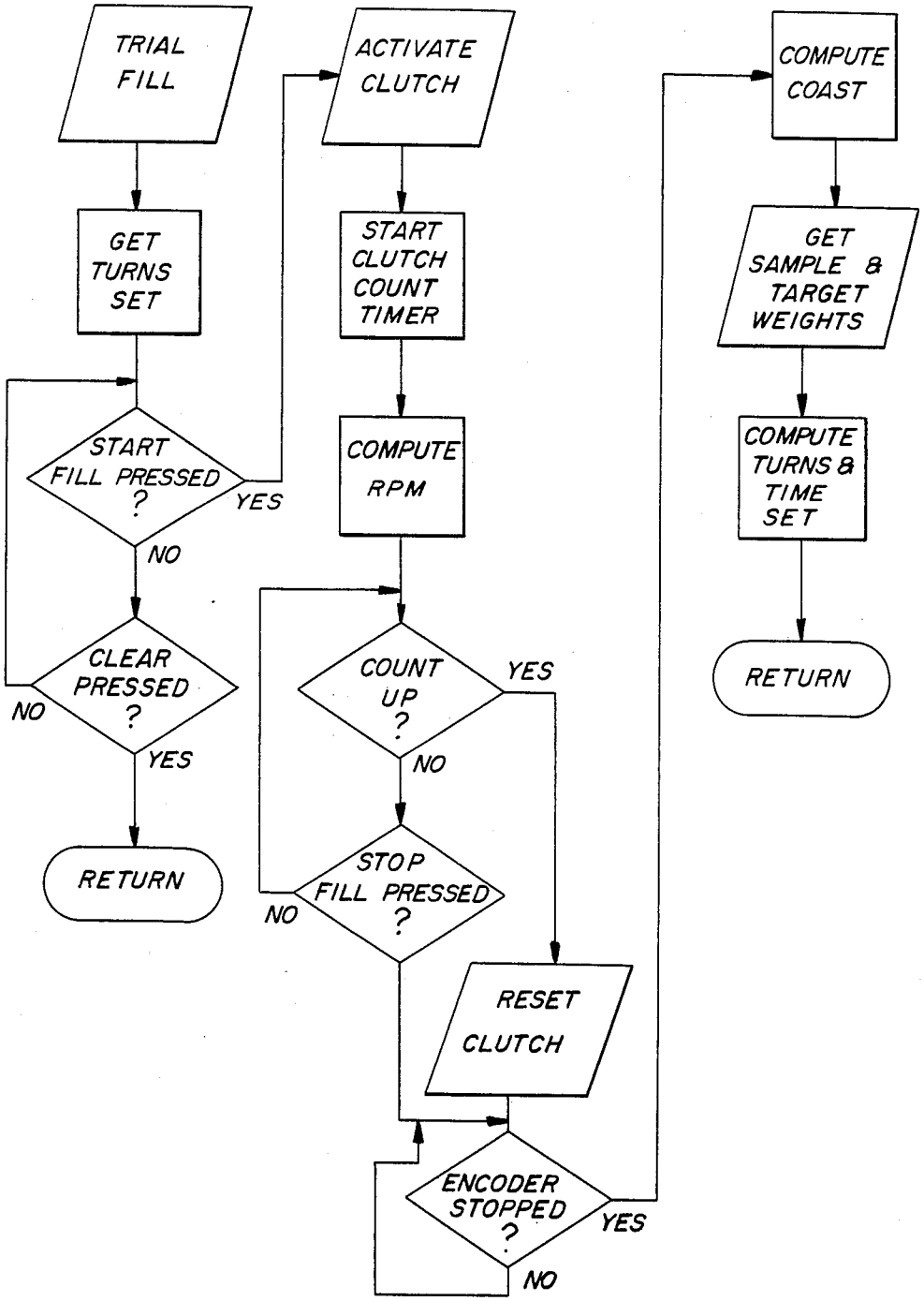
FIG. 4 is a flow chart illustrating the operation of the trial fill feature of the present invention.

The operation of the trial fill mode of the filler of the present invention is illustrated in the flow chart in FIG. 4. To place the filler in the trial fill mode, the operator presses a "Trial Fill" button which is provided on keyboard 54. This signals microprocessor 60 to recall from memory 66 the instructions for carrying out the trial fill mode. When the filler 10 is placed in the trial fill mode, microprocessor 60 generates a display which indicates that the filler is in the trial fill mode and also displays a prompt message to the operator via display panel 52. The prompt message to the operator requests him to enter a number of auger shaft revolutions for the trial fill. By means of the numerical keys on keyboard 54, the operator then enters a number of turns, which is generally less than the number of turns which the operator estimates is required to fill the container. The microprocessor 60 may also be programmed to drive the auger shaft for a predetermined number of revolutions in default of the operator entering a number. That is, if the operator fails to enter a number of revolutions in response to the prompt message, the microprocessor will enter a number for him.

Once the number of revolutions for the trial fill has been selected by either the operator or microprocessor 60, microprocessor 60 generates the prompt command "Press Start Fill", prompting the operator to depress the "Start Fill" key on the controller keyboard 54. The operator then initiates the trial fill cycle by depressing the "Start Fill" key.

When the "Start Fill" key is depressed, the clutch-brake 40 is activated, and auger shaft 24 begins to rotate. As shaft 24 rotates, shaft encoder assembly 26 generates a series of pulses as described above. These pulses are counted in microprocessor 60, and when the number of pulses counted indicates that the shaft 24 has rotated the preselected number of turns, clutch-brake 40 is reset to brake shaft 24. Microprocessor 60 then checks to make sure that shaft 24 has come to a complete stop.

Once shaft 24 has come to a complete stop, microprocessor 60 computes the amount of coast of the shaft during the trial fill cycle. As will be explained in greater detail below, coast is simply the difference between the actual number of turns as indicated by the shaft encoder assembly minus the preselected number of turns entered by the operator or selected by the microprocessor. The coast computed by microprocessor 60 is taken into account when calculating the number of turns required to dispense the desired weight and is also used in the coast compensation mode of operation to be explained in detail below.

After microprocessor 60 has computed the coast of the trial fill cycle, it generates a prompt requesting the operator to enter the sample weight, i.e., the weight of the material discharged during the trial fill cycle. The operator obtains the weight of the material, for example, by means of a scale, and enters the sample weight by means of the numeric keys on keyboard 54. Microprocessor 60 then prompts the operator to enter the target weight, that is, the weight desired to be filled into each container. The operator enters the target weight by means of keyboard 54 in the same manner as he enters the preselected number of turns and sample weight. After the sample weight and target weight have been entered, microprocessor 60 computes the number of turns of auger shaft 24 required to deliver the target weight into the container. This number of turns computed by the microprocessor is then used by the microprocessor as a set point for each fill cycle until the machine is reset for a different product or a different target weight.

An example will make the operation of the trial fill feature clear. Assume that five pounds of sugar are to be dispensed into containers. Therefore, the target weight, or $W_T$, is five pounds. For the trial fill cycle, the operator selects a number of revolutions, in this example let us say two revolutions of the auger. He enters this into the controller via keyboard 54, and the filler dispenses material by rotating the auger shaft two turns (plus coast). The operator then weighs the sugar dispensed by those two turns of the auger revolution and determines that the weight of sugar dispensed is one pound. This is the sample weight, or $W_S$. Knowing the sample weight and the number of revolutions of the auger which dispensed the sample weight, the weight of material dispensed per auger revolution may be determined. Thus, in this example, $W_S/R_A$ equals one half pound per revolution, where $R_A$ represents the number of auger revolutions selected by the operator for the trial fill cycle plus the amount of coast. Once this ratio is known, it is possible to calculate the number of revolutions required to give any desired weight. The target number of revolutions, $R_T$, required to deliver a target weight, $W_T$, is equal to the target weight divided by the ratio $W_S/R_A$. In this example, the target weight is five pounds and the ratio $W_S/R_A$ is one half. Thus, the target number of revolutions, $R_T$, required to dispense five pounds of sugar is equal to ten.

It will be appreciated that the trial fill mode of operation of the present invention provides a rapid, accurate and extremely simple method of determining the actual number of revolutions required to dispense a target weight. Only one fill is required, eliminating the need for repeated fill cycles required by the trial and error method necessary with current fillers.

Microprocessor 60 may also be programmed to operate in the timed auger rotation mode instead of the count mode of operation. In such a case, the trial fill mode would be the same as that for the count mode of operation, except that microprocessor 60 would calculate the amount of time auger 18 must rotate in order to dispense the target weight, along with the number of revolutions.

COAST COMPENSATION

Figure 5:
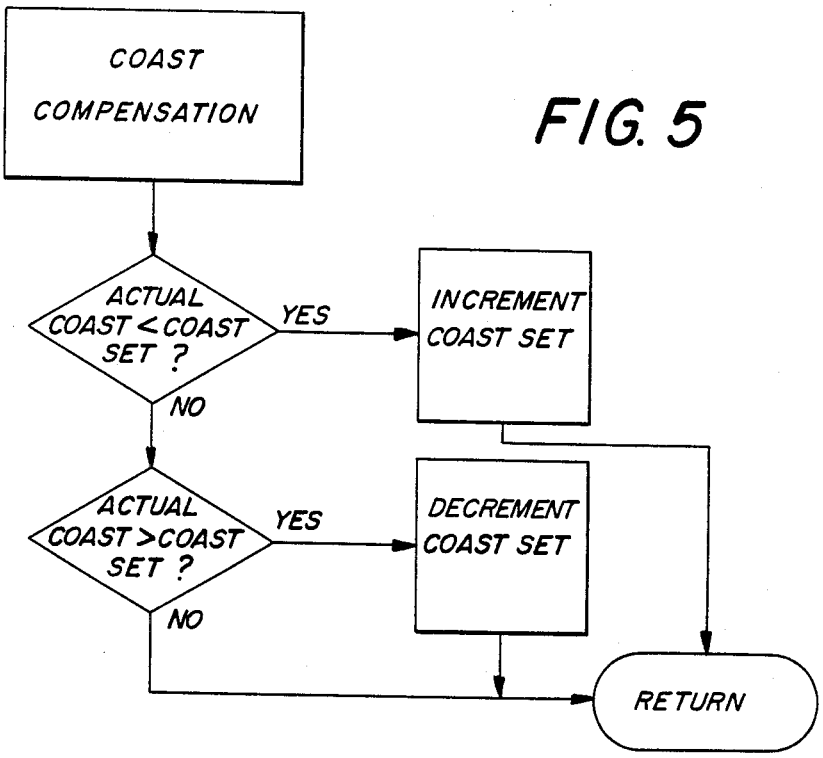
FIG. 5 is a flow chart illustrating the operation of the coast compensation feature of the present invention.

The coast compensation mode of operation of the present invention is illustrated in the flow chart of FIG. 5. Coast is the number of revolutions made by auger 18 after the signal to brake is given to clutch-brake 40. The purpose of coast compensation is to correct for variable and normally uncontrollable coast.

For each individual fill cycle, auger 18 rotates the number of revolutions calculated by microprocessor 60 during the trial fill mode to dispense the target weight. When microprocessor 60 determines that the auger 18 has rotated the required number of revolutions, auger 18 is braked by clutch-brake 40. Auger 18 continues to turn after braking as it coasts to a complete stop. The actual number of turns, from start to complete stop, is generated as described above by shaft encoder assembly 26 and fed to microprocessor 60. Microprocessor 60 compares the actual number of turns to the set number of turns calculated during trial fill for the particular product. If the actual number of turns measured by shaft encoder assembly 26 equals the set number of turns, no change is made to the set number of turns. However, if the actual number of turns is greater than the set number of turns, indicating an increase in coast, the microprocessor will decrement the true set number of turns to decrease the actual number of turns in succeeding fill cycles. If the actual number of turns is less than the set number of turns, indicating a decrease in the amount of coast, the microprocessor will increment the true set number of turns to increase the actual number of turns in succeeding fill cycles. The true set number of turns is changed preferably by 1/100th of a revolution on each succeeding cycle regardless of the amount of coast. This is done in order to prevent hunting. However, it is understood that the true set number of turns may be incremented or decremented by any number of revolutions or fractions of a revolution on each succeeding cycle without departing from the present invention.

The coast compensation mode of operation may be used separately or in conjunction with the trial fill mode of operation. That is, microprocessor 60 determines the amount of coast during the trial fill cycle and takes this into account when it sets the set number of turns. It may be assumed that the coast measured during the trial fill cycle will be reasonably close to the coast of succeeding fill cycles. By measuring the coast during the trial fill cycle and subtracting it from the calculated number of turns, the set number of turns will more accurately approximate the actual number of turns in succeeding fill cycles. Therefore, the true set point is the set number of turns minus the coast.

As an example, assume that during the trial fill example previously discussed, 45/100ths of a revolution of coast were measured. Since the microprocessor calculated that ten turns were required during the trial fill cycle, instead of using ten as the true set number of turns, the microprocessor subtracts the amount of coast from the trial fill cycle from the calculated number of turns. Thus, the microprocessor will set 10.00 minus 0.45, or 9.55, as the true set number of turns, so that the true set number of turns, 9.55, plus the anticipated coast of succeeding fill cycles, 0.45, will add up to 10. Assume that, several fill cycles later the measured coast increases to 55/100ths or 0.55. The actual number of turns is now 10.10. The true set point is then decremented by 1/100th of a revolution for each succeeding cycle, i.e., the true set point is moved back to 9.54, 9.53, etc. until the set true point is decremented to 9.45 to compensate for a coast of 0.55.

It will be appreciated that the coast compensation feature of the present invention provides a simple yet effective way of compensating for and eliminating the adverse effects of coast.

The present invention may be embodied in other specific forms without departing from the spirit or essential attributes thereof, and, accordingly, reference should be made to the appended claims, rather than to the foregoing specification, as indicating the scope of the invention.

We claim:

1. A filler for volumetrically dispensing a desired weight of material into containers to be filled by weight, comprising:

(a) a hopper means for storing the material to be dispensed by the filler;

(b) rotary feed means operatively associated with the hopper means for dispensing controlled volumes of material from a discharge opening in the hopper means into the containers to be filled, said volumes being directly proportional to the number of revolutions of the rotary feed means;

(c) means for sensing the number of revolutions of the rotary feed means and generating a signal indicative of the number of revolutions, (d) control means for selectably controlling the number of revolutions of the rotary feed means to either a preselected fixed number or a calculated number of revolutions, the control means further having means for entering a first weight value indicative of the weight of a volume of material delivered by the preselected fixed number of revolutions of the rotary feed means, means for entering a second weight value indicative of a desired weight of material to be dispensed by the filler, said desired weight value being independent of volume, means for deriving the ratio of the first weight value to the preselected fixed number of revolutions of the rotary feed means, and means for dividing the second weight value by said ratio to derive the calculated number of revolutions, the calculated number being indicative of the number of revolutions required to dispense the second weight value; and (e) cyclically engagable drive means operatively associated with the rotary feed means and responsive to the control means for rotating the rotary feed means by either the preselected fixed number or the calculated number of revolutions as selected by the control means.

2. Apparatus as in claim 1 wherein the rotary feed means comprises a screw auger.

3. Apparatus as in claim 1, wherein the rotary feed means comprises a rotary pump.

4. Apparatus as in claim 1, 2 or 3 wherein the means for sensing the number of revolutions of the rotary feed means comprises a shaft encoder.

5. Apparatus as in claim 4, wherein the shaft encoder comprises a light chopper fixed to the rotary feed means for rotation therewith and a photodetector for detecting the light chopped by the light chopper and converting the detected light into electrical signals.

6. Apparatus as in claim 1, wherein the control means includes a microprocessor.

7. Apparatus as in claim 1, wherein the means for entering the first and second weight values is an operator-actuable keyboard.

8. Apparatus as in claim 1, wherein the drive means comprises a motor and a clutch-brake coupled to said motor.

9. Apparaus as in claim 8, wherein the motor is an electric motor.

10. A filler for volumetrically dispensing a desired weight of material into containers to be filled by weight, comprising:

(a) a hopper means for storing the material to be dispensed by the filler;

(b) rotary feed means operatively associated with the hopper means for dispensing controlled volumes of material from a discharge opening in the hopper means into the containers to be filled, said volumes being directly proportional to the time of revolution of the rotary feed means;

(c) means for measuring the amount of time the rotary feed means revolves and generating a signal indicative of the time;

(d) control means for selectably controlling the time the rotary feed means revolves to either a preselected fixed time or a calculated time, the control means further having means for entering a first weight value indicative of the weight of a volume of material delivered by the preselected fixed time of revolution of the rotary feed means, means for entering a second weight value indicative of a desired weight of material to be dispensed by the filler, said desired weight value being independent of volume, means for deriving the ratio of the first weight value to the preselected fixed time of revolution of the rotary feed means, and means for dividing the second weight value by said ratio to derive the calculated time of revolution, the calculated time being indicative of the time required to dispense the second weight value; and (e) cyclically engagable drive means operatively associated with the rotary feed means and responsive to the control means for rotating the rotary feed means by either the preselected fixed time or the calculated time of revolution as selected by the control means.

11. Apparatus as in claim 10, wherein the rotary feed means comprises a screw auger.

12. Apparatus as in claim 10, wherein the rotary feed means comprises a rotary pump.

13. Apparatus as in claim 10, 11 or 12 wherein the means for measuring the amount of time the rotary feed means revolves comprises a shaft encoder and clock means operatively associated with the shaft encoder.

14. Apparatus as in claim 13, wherein the shaft encoder comprises a light chopper fixed to the rotary feed means for rotation therewith and a photodetector for detecting the light chopped by the light chopper and converting the detected light into electrical signals.

15. Apparatus as in claim 10, wherein the control means includes a microprocessor.

16. Apparatus as in claim 10, wherein the means for entering the first and second weight values is an operator-actuable keyboard.

17. Apparatus as in claim 10, wherein the drive means comprises a motor and a clutch-brake coupled to said motor.

18. Apparatus as in claim 17, wherein the motor is an electric motor.

19. A filler for volumetrically dispensing a desired weight of material into containers to be filled by weight, comprising:

(a) hopper means for storing the material to be dispensed by the filler;

(b) rotary feed means operatively associated with the hopper means for dispensing controlled volumes of material from a discharge opening in the hopper means into the containers to be filled, said volumes being directly proportional to the number of revolutions of the rotary feed means;

(c) cyclically engagable drive means for rotating the rotary feed means;

(d) brake means for causing the rotation of the rotary feed means to stop after a desired number of revolutions;

(e) means for sensing the actual number of revolutions of the rotary feed means from the time the drive means is engaged until the rotary feed means comes to a complete stop and generating a signal indicative of the actual number of revolutions;

(f) comparison means for comparing the actual number of revolutions of the rotary feed means to said desired number of revolutions; and (g) control means responsive to said comparison means for actuating said brake means after the rotary feed means has rotated a predetermined number of revolutions and for incrementing said predetermined number by a preselected amount when the actual number of revolutions is less than said desired number and decrementing said predetermined number by said preselected amount when the actual number of revolutions is greater than said desired number.

20. Apparatus as in claim 19, wherein the rotary feed means comprises a screw auger.

21. Apparatus as in claim 19, wherein the rotary feed means comprises a rotary pump.

22. Apparatus as in claim 19, wherein said drive means comprises a motor.

23. Apparatus as in claim 22, wherein said motor is an electric motor.

24. Apparatus as in claim 19 wherein said means for sensing the actual number of revolutions of said feed means comprises a shaft encoder.

25. Apparatus as in claim 24, wherein the shaft encoder comprises a light chopper fixed to the rotary feed means for rotation therewith and a photodetector for detecting the light chopped by the light chopper and converting the detected light into electrical signals.

26. Apparatus as in claim 19, wherein said control means includes a microprocessor.

27. A filler for volumetrically dispensing a desired weight of material into containers to be filled by weight, comprising:

(a) a hopper means for storing the material to be dispensed by the filler;

(b) rotary feed means operatively associated with the hopper means for dispensing controlled volumes of material from a discharge opening in the hopper means into the containers to be filled, said volumes being directly proportional to the number of revolutions of the rotary feed means;

(c) cyclically engagable drive means for rotating the rotary feed means;

(d) brake means for causing the rotation of the rotary feed means to stop after a desired number of revolutions;

(e) means for sensing the actual number of revolutions of the rotary feed means from the time the drive means is engaged until the rotary feed means comes to a complete stop and generating a signal indicative of the actual number of revolutions;

(f) control means for generating said desired number, said desired number being either a preselected fixed number or a calculated number, the control means having as an input the signal indicative of the actual number of revolutions, the control means further having means for entering a first weight value indicative of the weight of a volume of material delivered by the preselected fixed number of revolutions of the rotary feed means, means for entering a second weight value indicative of a desired weight of material to be dispensed by the filler, means for deriving the ratio of the first weight value to the preselected fixed number of revolutions of the rotary feed means, means for dividing the second weight value by said ratio to derive the calculated number, the calculated number being indicative of the number of revolutions required to dispense the second weight value, means for comparing the actual number of revolutions of the rotary feed means to said desired number of revolutions, and means for actuating said brake means after the rotary feed means has rotated a predetermined number of revolutions and for incrementing said predetermined number by a preselected amount when the actual number of revolutions is less than said desired number and decrementing said predetermined number by said preselected amount when the actual number of revolutions is greater than said desired number, the control means being operatively associated with the drive means to rotate the rotary feed means by said predetermined number.

28. Apparatus as in claim 27, wherein the rotary feed means comprises a screw auger.

29. Apparatus as in claim 27, wherein the drive means comprises a motor.

30. Apparatus as in claim 29, wherein the motor is an electric motor.

31. Apparatus as in claim 27, wherein the means for sensing the actual number of revolutions of the rotary feed means comprises a shaft encoder.

32. Apparatus as in claim 31, wherein the shaft encoder comprises a light chopper fixed to the rotary feed means for rotation therewith and a photodetector for detecting the light chopped by the light chopper and converting the detected light into electrical signals.

33. Apparatus as in claim 27, wherein the control means includes a microprocessor.

34. A filler for volumetrically dispensing a desired weight of material into containers to be filled by weight, comprising:

(a) a hopper means for storing the material to be dispensed by the filler;

(b) rotary feed means operatively associated with the hopper means for dispensing controlled volumes of material from a discharge opening in the hopper means into the containers to be filled, said volumes being directly proportional to the time of revolution of the rotary feed means;

(c) cyclically engagable drive means for rotating the rotary feed means;

(d) brake means for causing the rotation of the rotary feed means to stop after a desired time of revolution;

(e) means for sensing the actual time of revolution of the rotary feed means from the time the drive means is engaged until the rotary feed means comes to a complete stop and generating a signal indicative of the actual time of revolution;

(f) control means for generating said desired time of revolution, said desired time of revolution being either a preselected fixed time or a calculated time, the control means having as an input the signal indicative of the actual time of revolution, the control means further having means for entering a first weight value indicative of the weight of a volume of material delivered by the preselected fixed time of revolution of the rotary feed means, means for entering a second weight value indicative of a desired weight of material to be dispensed by the filler, means for deriving the ratio of the first weight value to the preselected fixed time of revolution of the rotary feed means, means for dividing the second weight value by said ratio to derive the calculated time, the calculated time being indicative of the time of revolution required to dispense the second weight value, means for comparing the actual time of revolution of the rotary feed means to said desired time of revolution, and means for actuating said brake means after the rotary feed means has rotated a predetermined time and for incrementing said predetermined time by a preselected amount when the actual time of revolution is less than said desired time and decrementing said predetermined time by said preselected amount when the actual time of revolution is greater than said desired time, the control means being operatively associated with the drive means to rotate the rotary feed means for said predetermined time.

35. Apparatus as in claim 34, wherein the rotary feed means comprises a screw auger.

36. Apparatus as in claim 34, wherein the drive means comprises a motor.

37. Aparatus as in claim 36, wherein the motor is an electric motor.

38. Apparatus as in claim 34, wherein the means for sensing the actual number of revolutions of the rotary feed means comprises a shaft encoder.

39. Apparatus as in claim 38, wherein the shaft encoder comprises a light chopper fixed to the rotary feed means for rotation therewith and a photodetector for detecting the light chopped by the light chopper and converting the detected light into electrical signals.

40. Apparatus as in claim 34, wherein the control means includes a microprocessor.

41. Method of determining the number of revolutions required of a rotary feed means in a filling machine of the type employing a rotary feed means and a hopper to volumetrically deliver a desired weight of material into containers being filled, comprising the steps of:

(a) rotating the rotary feed means through a preselected fixed number of revolutions to thereby dispense a volume of material directly proportional to the preselected fixed number of revolutions;

(b) collecting the dispensed volume of material in a container;

(c) weighing the container and material and determining the weight of the dispensed volume of material;

(d) determining the ratio of the preselected fixed number of revolutions to said weight;

(e) determining the product of said ratio multiplied by the desired weight of material; and (f) rotating the rotary feed means through a number of revolutions equal to said product to dispense said desired weight.

42. Method of compensating for continued rotation after braking of a rotating shaft which is caused to rotate and then braked after rotating through a predetermined number of revolutions in order to have the shaft come to a complete stop after a desired number of revolutions, comprising the steps of:

(a) measuring the actual number of revolutions of the shaft from the time it is first caused to rotate until it comes to a complete stop after braking;

(b) comparing the actual number of revolutions to the desired number of revolutions; and (c) incrementing said predetermined number of revolutions of a preselected amount when the actual number of revolutions is less than said desired number and decrementing said predetermined number by said preselected amount when the actual number of revolutions is greater than said desired number.

43. Method of determining the number of revolutions required of a rotary feed means in a filling machine of the type employing a rotary feed means and a hopper to volumetrically deliver a desired weight of material into containers being filled and of compensating for continued rotation of said rotary feed means after a braking signal is applied to said rotary feed means when said rotary feed means has rotated through said number of revolutions in order to have said rotary feed means come to a complete stop after a desired number of revolutions, comprising the steps of:

(a) rotating the rotary feed means through a preselected fixed number of revolutions to thereby dispense a volume of material directly proportional to the preselected fixed number of revolutions;

(b) collecting the dispensed volume of material in a container;

(c) weighing the container and material and determining the weight of the dispensed volume of material;

(d) determining the ratio of the preselected fixed number of revolutions to said weight;

(e) determining the product of said ratio multiplied by the desired weight of material;

(f) rotating the rotary feed means through a number of revolutions equal to said product to dispense said desired number;

(g) measuring the actual number of revolutions of the shaft from the time it is first caused to rotate until it comes to a complete stop after braking;

(h) comparing the actual number of revolutions to said product; and (i) incrementing said product by a preselected amount when the actual number of revolutions is less than said desired number and decrementing said product by said preselected amount when the actual number of revolutions is greater than said desired number.

44. Method of determining the time of revolution required of a rotary feed means in a filling machine of the type employing a rotary feed means and a hopper to deliver a desired weight of material into containers being filled, comprising the steps of:

(a) rotating the rotary feed means for a preselected fixed time to thereby dispense a volume of material directly proportional to the preselected fixed time of revolution;

(b) collecting the dispensed volume of material in a container;

(c) weighing the container and material and determining the weight of the dispensed volume of material;

(d) determining the ratio of the preselected fixed time of revolution to said weight;

(e) determining the product of said ratio multiplied by the desired weight of material; and (f) rotating the rotary feed means for a time of revolution equal to said product to dispense said desired weight.

45. Method of compensating for continued rotation after braking of a rotating shaft which is caused to rotate and then braked after rotating for a predetermined time in order to have the shaft come to a complete stop after a desired time, comprising the steps of:

(a) measuring the actual time of revolution of the shaft from the time it is first caused to rotate until it comes to a complete stop after braking;

(b) comparing the actual time of revolution to the predetermined time of revolution; and (c) incrementing said predetermined time of revolution by a preselected amount when the actual time of revolution is less than said predetermined time and decrementing said predetermined time of said preselected amount when the actual time of revolution is greater than said predetermined time.

46. Method of determining the time of revolution required of a rotary feed means in a filling machine of the type employing a rotary feed means and a hopper to volumetrically deliver a desired weight of material into containers being filled and of compensating for continued rotation of said rotary feed means after a braking signal is applied to said rotary feed means when said rotary feed means has rotated for said time in order to have said rotary feed means come to a complete stop after a desired time of revolution, comprising the steps of:

(a) rotating the rotary feed means for a preselected fixed time to thereby dispense a volume of material directly proportional to the preselected fixed time;

(b) collecting the dispensed volume of material in a container;

(c) weighing the container and material and determining the weight of the dispensed volume of material;

(d) determining the ratio of the preselected fixed time of revolution to said weight;

(e) determining the product of said ratio multiplied by the desired weight of material;

(f) rotating the rotary feed means for a time of revolution equal to said product to dispense said desired weight;

(g) measuring the actual time of revolution of the shaft from the time it is first caused to rotate until it comes to a complete stop after braking;

(h) comparing the actual time of revolution to said product; and (i) incrementing said product by a preselected amount when the actual time of revolution is less than said desired time and decrementing said product by said preselected amount when the actual time of revolution is greater than said desired time.

47. A filler for volumetrically dispensing a desired weight of material into containers to be filled by weight, comprising:

(a) a hopper means for storing the material to be dispensed by the filler;

(b) rotary feed means operatively associated with the hopper means for dispensing controlled volumes of material from a discharge opening in the hopper means into the containers to be filled, said volumes being directly proportional to the time of revolution of the rotary feed means;

(c) cyclically engagable drive means for rotating the rotary feed means;

(d) brake means for causing the rotation of the rotary feed means to stop after a desired time of revolution;

(e) means for sensing the actual time of revolution of the rotary feed means from the time the drive means is engaged until the rotary feed means comes to a complete stop and generating a signal indicative of the actual time of revolution;

(f) comparison means for comparing the actual time of revolution of the rotary feed means to said desired time of revolution; and (g) control means responsive to said comparison means for actuating said brake means after the rotary feed means has rotated a predetermined time and for incrementing said predetermined time by a preselected amount when the actual time of revolution is less than said desired time of revolution and decrementing said predetermined time by said preselected amount when the actual time of revolution is greater than said desired time of revolution.

48. Apparatus as in claim 47, wherein the rotary feed means comprises a screw auger.

49. Apparatus as in claim 47, wherein the rotary feed means comprises a rotary pump.

50. Apparatus as in claim 47, wherein said drive means comprises a motor.

51. Apparatus as in claim 50, wherein said motor is an electric motor.

52. Apparatus as in claim 47, wherein said means for sensing the actual time of revolution of said feed means comprises a shaft encoder.

53. Apparatus as in claim 52, wherein the shaft encoder comprises a light chopper fixed to the rotary feed means for rotation therewith and a photodetector for detecting the light chopped by the light chopper and converting the detected light into electrical signals.

54. Apparatus as in claim 47, wherein said control means includes a microprocessor.

* * * * *